United States Patent [19]

Urawa et al.

[11] Patent Number: 4,571,372

[45] Date of Patent: Feb. 18, 1986

[54] METHOD FOR COATING A NON-MAGNETIC DEVELOPER ONTO A DEVELOPER HOLDING MEMBER

[75] Inventors: Motoo Urawa, Funabashi; Masanori Takenouchi, Urawa; Fumitaka Kan, Yokohama; Kohshi Suematsu, Kawasaki; Eiichi Imai, Narashino, all of Japan

[73] Assignee: Canon Kabushiki Kaisha, Tokyo, Japan

[21] Appl. No.: 602,010

[22] Filed: Apr. 19, 1984

[30] Foreign Application Priority Data

| | | | |
|---|---|---|---|
| Apr. 22, 1983 | [JP] | Japan | 58-70996 |
| Apr. 23, 1983 | [JP] | Japan | 58-71686 |
| Apr. 23, 1983 | [JP] | Japan | 58-71687 |
| Apr. 23, 1983 | [JP] | Japan | 58-71688 |
| Apr. 23, 1983 | [JP] | Japan | 58-71689 |
| Apr. 23, 1983 | [JP] | Japan | 58-71690 |

[51] Int. Cl.[4] ..... G03G 9/08; G03G 13/06; G03G 15/09

[52] U.S. Cl. ..... 430/122; 118/657; 118/658; 430/102; 430/120

[58] Field of Search ..... 430/102, 120, 122; 118/657, 658

[56] References Cited

U.S. PATENT DOCUMENTS

| | | | |
|---|---|---|---|
| 4,200,665 | 4/1980 | Suzuki et al. | 118/658 X |
| 4,365,586 | 12/1982 | Hosono et al. | 118/658 X |
| 4,373,798 | 2/1983 | Tsukada et al. | 118/658 X |
| 4,377,332 | 3/1983 | Tamura | 118/658 X |
| 4,385,829 | 5/1983 | Nakahata et al. | 430/122 X |
| 4,418,643 | 12/1983 | Barto, Jr. et al. | 118/657 |
| 4,420,242 | 12/1983 | Yamashita | 118/657 |
| 4,425,373 | 1/1984 | Hosono et al. | 118/658 X |
| 4,430,411 | 2/1984 | Tamura et al. | 430/122 |
| 4,444,864 | 4/1984 | Takahashi | 430/122 X |

OTHER PUBLICATIONS

Takahasi et al., "Mechanism of Canon Toner Projection Development", Photographic Science and Engineering, vol. 26, No. 6, Sep./Oct. 1982, pp. 254–261.

*Primary Examiner*—John Kittle
*Assistant Examiner*—Mukund J. Shah
*Attorney, Agent, or Firm*—Fitzpatrick, Cella, Harper & Scinto

[57] ABSTRACT

A method for coating of a developer comprises using a device having a vessel for storing a non-magnetic developer and magnetic particles, a developer holding member which conveys with rotation the non-magnetic developer to a latent image bearing member, a regulating member positioned on the side of the outlet of the above vessel for feeding the non-magnetic developer and arranged on the developer holding member with a gap formed therebetween, and a magnetic pole arranged on the side opposite to the regulating member through the intermediary developer holding member for forming a magnetic brush with the magnetic particles on the upstream side of the regulating member on the developer outlet side of said vessel; and forming a thin layer of the non-magnetic developer on the developer holding member, said magnetic particles having a magnetization of 30 emu/g or higher in the external magnetic field of 5000 oersted.

13 Claims, 3 Drawing Figures

METHOD FOR COATING A NON-MAGNETIC DEVELOPER ONTO A DEVELOPER HOLDING MEMBER

BACKGROUND OF THE INVENTION

1. Field of the Invention

This invention relates to a coating method which develops an electrostatic latent image with a non-magnetic developer.

2. Description of the Prior Art

In the prior art, various devices have been proposed and practically used as the dry system one-component developing device. However, in any of these developing systems, it is very difficult to form a thin layer of a dry system one-component developer and therefore developing devices have been constituted so as to form relatively thick layers. Whereas, at the present time, when improvement of sharpness, resolution, etc. is sought after, development of a method for thin layer formation with the dry system one-component developer is essentially required.

As the method for forming a thin layer of a dry system one-component developer known in the art, the method as disclosed in Japanese Laid-open Patent Application No. 43037/1979 is proposed and practically applied. However, this concerned thin layer formation of a magnetic developer. A magnetic toner must contain a magnetic material added internally therein in order to have magnetic property. This, however, involves problems such as bad fixing characteristic when heat fixing the developed image transferred to a transfer paper or bad color during color reproduction due to internal addition of a magnetic material to the developer itself.

For overcoming these drawbacks, there have been proposed the method in which soft fur such as fur of a beaver is formed into a cylindrical brush and the developer is attached thereon for coating, and the method in which the developer is applied to a developing roller of which surface is made of a fiber such as velvet by means of a doctor blade, etc. However, when an elastic blade is used as the doctor blade for the above fiber brush, although the amount of the developer can be regulated, no even coating can be effected. Further, since triboelectric charges cannot be imparted to the developer existing between the fibers of the brush by only friction of the fiber brush on the developing roller, there has been the problem that ghost or other inconveniences will readily be generated. Besides, presence of non-magnetic developer made it difficult to prevent leak of the developer from the device.

SUMMARY OF THE INVENTION

An object of the present invention is to cancel the problems of the prior art as described above and provide a novel coating method in which a developer is coated by forming a thin layer of the developer on the surface of a developer holding member and giving sufficient triboelectric charges thereto.

Another object of the present invention is to provide a novel coating method by which a stable and uniform thin developer layer is formed even in a large number of successive operations by forming a thin layer of the developer on the surface of a developer holding member and giving sufficient triboelectric charges thereto.

Still another object of the present invention is to enable prevention of leak-out of the abovementioned non-magnetic developer from the developing device.

According to the present invention, there is provided a method for coating of a developer which comprises using a device having a vessel for storing a non-magnetic developer and magnetic particles;

a developer holding member which conveys with rotation the non-magnetic developer to a latent image bearing member, a regulating member positioned on the side of the outlet of the above vessel for feeding the non-magnetic developer and arranged on the developer holding member with a gap formed therebetween; and a magnetic pole arranged on the side opposite to the regulating member through the intermediary developer holding member for forming a magnetic brush with the magnetic particles on the upstream side of the regulating member on the developer outlet side of said vessel, and forming a thin layer of the non-magnetic developer on the developer holding member, said magnetic particles having a magnetization of 30 emu/g or higher in the external magnetic field of 500 oersted.

DETAILED DESCRIPTION OF THE PREFERRED EMBODIMENTS

The latent image bearing member of the present invention is a drum-shaped or belt-shaped member having a photosensitive member or an insulating material layer, and the magnetic pole employed may be attached as the magnetic pole of the same or different polarity in the axis direction of the magnet roller or a plural rod-shaped magnets may be adhered on a fixing supporting member. Further, the rotating developer holding member may be a sleeve made of a non-magnetic metal such as aluminum, copper, stainless steel, brass, and the like or a synthetic resin material, or an endless belt of a resin or a metal, and its peripheral surface may be roughened or patternized unevenly for enhancing conveying performance or charging characteristics, if desired. As the regulating member, a blade plate or a wall made of a magnetic material such as iron or a non-magnetic material such as aluminum, copper, resins and the like may be used.

Referring now to the accompanying drawings, the present invention is to be described in more detail.

Figure 1:
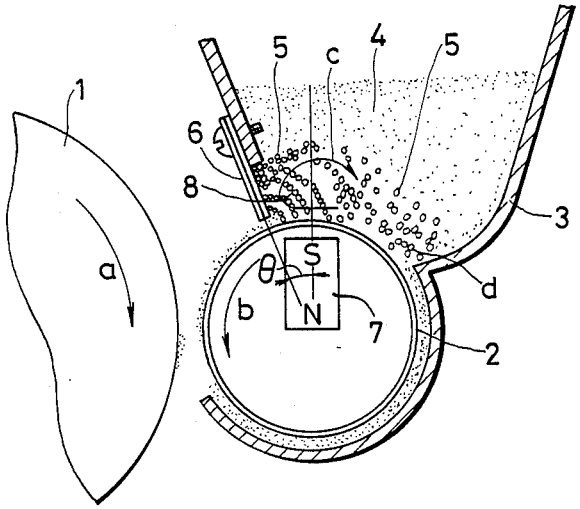
FIG. 1 is a sectional view of the developing device for explanation of the principle of the present invention.

FIG. 1 shows a sectional view of a developing device for explanation of the developing principle for applying the coating method of the present invention.

In the Figure, 1 is an electrophotographic photosensitive drum, which holds a latent image formed by a latent image forming means (not shown) and passes the developing position shown in the Figure by rotating in the direction of the arrowhead a. Confronting this photosensitive drum 1 is a non-magnetic sleeve 2 which is the developer holding member for holding a developer at a predetermined gap therebetween, and the sleeve 2 also rotates in the direction of the arrowhead b. Above the sleeve 2 is positioned a vessel 3 made of a non-magnetic material such as a resin, aluminum, etc. for storing a mixture of a non-magnetic developer 4 and magnetic particles 5, and downstream in the sleeve rotational direction of the vessel 3 there is fixed a magnetic blade 6 or regulating member.

On the other hand, on the opposite side of the sleeve 2 to the magnetic blade 6 is provided a magnet 7. This magnet is mounted at a position which is determined by the relation between the position of the magnetic pole and the magnetic blade 6. Practically, through the action of the magnetic field formed by providing a magnetic pole slightly upsteam side of the position of the magnetic blade 6, further favorable results can be obtained with respect to prevention of flow-out of magnetic particles and uniform coating of the developer.

In the above constitution, the magnetic particles 5 in the vessel 3 form a magnetic brush 8 by the magnetic field generated in between the S-pole of the magnet 7 and the magnetic blade 6. And, by rotation of the sleeve 2, the magnetic particles and the non-magnetic developer are stirred and mixed while holding the above magnetic brush 8. Under this state, on the magnetic blade side of the vessel 3, the movement of the mixture of the non-magnetic developer and the magnetic particles is barred by the presence of the blade 6 and the mixture ascends to be circulated in the direction of the arrowhead c.

In this way, the non-magnetic developer, through mixing with the magnetic particles, is triboelectrically charged by the sleeve 2 or the magnetic particles. The charged developer is applied by the magnetic brush 8 formed in the vicinity of the magnetic blade 6, the charged developer is applied evenly and thinly to the surface of the sleeve 2 through image force and reaches the confronting position against the photosensitive drum.

The magnetic particles 5 constituting the magnetic brush 8 will not flow out on the sleeve 2 by setting the restraining force by the magnetic field of the magnet 7 greater than the conveying force caused by frictional force. And, if the non-magnetic developer exists within the region of the magnetic brush 8, the ratio of magnetic particles of the magnetic brush 8 to the developer can be maintained virtually constant by the rotation of the sleeve 2. Accordingly, even if the developer on the sleeve may be consumed by development, the developer can be supplied automatically into the region of the magnetic brush 8. Thus, it is rendered possible to effect coating by supplying constantly a predetermined quantity of the developer onto the sleeve 2.

In the above explanation of the principle, a magnetic blade is used as the regulating member, but it is also possible to use a non-magnetic blade or a wall of a non-magnetic member such as resins, aluminum and the like constituting the vessel as the regulating member. In this case, however, for prevention of flow-out of the magnetic particles, the gap between the sleeve and the regulating member is required to be made smaller than that when using a magnetic blade. Also, the use of a magnetic blade is preferred because the magnetic brush is formed stably at the outlet for the developer by the magnetic field between the blade and the magnet pole.

In the above developing device shown in FIG. 1, on account of the developer which is a non-magnetic developer, there may sometimes ensue the problem that the developer is readily leaked through the region d on the side where the sleeve 2 enters the vessel 3. For prevention of such a leak of the developer through the region d, a magnetic brush may be formed between the sleeve and the vessel on the side where the above sleeve enters the vessel.

The conditions for applying only the non-magnetic developer to the sleeve while restraining the magnetic particles by the regulating member are described below in detail. The restraining force F acting on the magnetic particles is represented by the following equation:

$$F = \frac{1}{8\pi} V(MH) = \frac{\mu - 1}{8\pi} VH^2$$

where M is magnetization of magnetic particles and $\mu$ is permeability. That is, the magnetic field should desirably be changed greatly at the side of the regulating member 6. This can be accomplished by providing the magnet 7 on the upstream side of the position of the regulating member 6 in the direction of the progress of the sleeve, thereby permitting the slanted portion of the magnetic field distribution to correspond to the site of the regulating member.

The present inventors paid attention to the marked effect of the value of magnetization of magnetic particles on the restraining conditions and have made investigations about the relation between the maximum magnetization of magnetic particles (the value of saturated magnetization by a magnetic field of 5000 oersted or higher) and the restraining conditions, but no clear correlation could be obtained.

On the other hand, the magnetic field by a commercially readily available magnet is about 1500 oersted at the maximum by measurement on the sleeve. In the case of using a part in which the magnetic distribution is abruptly changed for the magnet in the regulating member as in the present invention, the magnetic field in the regulating member portion should appropriately be about 500 oersted or lower, and the magnetic particles are used with unsaturated region of magnetization. As for the magnetic field by the magnet, it should desirably be stronger with respect to restraint of the magnetic particles. However, if this magnetic field is too strong, the magnetic particles will be restrained strongly toward the stronger portion of the magnet pole, whereby the circulation movement of the magnetic particles by rotation of the sleeve as described above is obstructed to result readily in generation of streaks or irregularities on the coated layer of the non-magnetic toner. For this reason, for promotion of the circulation movement of the magnetic particles, there is also a tendency that a weaker magnetic field of the magnet may sometimes be welcomed.

The present inventors have accomplished a solution of the contradictory requirements concerning strength of magnetic field as described above by use of magnetic particles having a magnetization of 30 emu/g or higher in an external magnetic field of 500 oersted, thereby obtaining the effect that they can be restrained by the blade portion even in a weak magnetic field and also the effect of good circulation of particles.

As apparently seen from the foregoing description, the magnetic particles are particularly important as the constituent element in the present invention. The above magnetic particles must fulfill the function of forming a magnetic brush in a system where a non-magnetic developer exists in an amount by far greater than the magnetic particles, applying the non-magnetic developer onto a non-magnetic developer holding member and regulating its amount, rather than the function possessed by the magnetic particles used as the carrier material in a two-component system developer of the prior art mixed with a toner (non-magnetic developer) in amount by far greater than the toner, namely the function primarily of imparting charges to the toner and controlling the amount of charges. At the same time, they must have the function of feeding a non-magnetic developer while moving under circulation and, further, the magnetic particles are not desired to pass through the regulating member. In order to satisfy these functions, the magnetic particles must be suitably restrained by the force generated by the magnetic field and yet also exhibit appropriate circulating performance. Moreover, the magnetic brush formed with magnetic particles must have a suitable hardness and density enabling uniform coating. For example, a relatively coarse brush tends to form streaks due to insufficient regulation on the developer holding member. Conversely, a dense brush tends to make the thickness of the coated layer on the holding member extremely thin. Thus, neither of these is preferred. Further, to mention one example, if the circulating performance is too good, the coated layer will become thicker, whereby fog may be formed on the image. On the contrary, if the circulation performance is poor, various drawbacks may be sometimes caused such that ghosting will readily occur.

The present inventors have made various investigations in order for the magnetic particles to be used in the present invention to satisfy various necessary functions, and consequently have found that the particle sizes and particle size distribution of the magnetic particles have extremely great effects on these functions.

For complete prevention of flow-out of the magnetic particles and prevention of variation in the proportions of the non-magnetic developer and the magnetic particles by attachment on the image or flow-out from the vessel, the requisite condition for the magnetic particles is to satisfy the following relation between the average particle size $\overline{\gamma}$ as measured for the maximum length of said magnetic particles and the gap d between the blade and the surface of the sleeve member:

$$n\overline{\gamma}=d$$

where $1.00<n<5.00$, and d is a value not smaller than the average particle size of the non-magnetic developer. More preferably, the range of the particle size of the magnetic particles should be such that 70% or more of the total particles are included within ±20% of said average particle size $\overline{\gamma}$.

The particle size of the magnetic particle mentioned here refers to the longest length of the particle, that is, the maximum distance among the parallel tangential lines contacted externally on the particle. This is measured by an image analyzer (for example, Boshlom image analyzer Omnicon FAS-II, produced by Shimazu Seisakusho) for a photographic image of the particle obtained by a transmission microscope or a scanning type electron microscope.

Here, if n is less than 1.00, fine streaks may sometimes be generated on the coated layer of the non-magnetic developer, and when developing is effected with the use of this coated layer, good image can be obtained under the environment of normal temperature and normal humidity, but under the environment of lower temperature and lower humidity, fog may sometimes be caused.

On the other hand, if n exceeds 5.00, the packing density of the magnetic particles becomes greater at the site where the sleeve and the blade are approached near to each other to make the thickness of the coated layer of the non-magnetic toner very thin and give insufficient image density. Also, in some cases, a small amount of magnetic particles may undesirably flow out.

Thus, by making the relation between the average particle size measured at the maximum length of the magnetic particles and the gap between the blade and the sleeve surface satisfy the equation $n\overline{\gamma}=d$ $(1.00<n<5.00)$, constantly stable coating can be obtained.

As a more preferable condition, the average particle size of said magnetic particles is under the condition satisfying the above equation, and, the range of the particle size should be such that 70% or more in number of the total magnetic particles are included within ±20% of said average particle size $\gamma$. By giving this condition to the magnetic particles, it is possible to obtain an image of very high resolution without scattering or fogging. The cause for bringing this effect has not been clarified so far, but it may be considered that this condition enables to make uniform the packing density of the developer in the coated layer of the non-magnetic developer.

The present inventors have made various investigations as to the conditions enabling to attain various necessary functions, and consequently found that in addition to the particle sizes, particle size distribution and magnetic characteristics of the magnetic particles, as a matter of course, the surface shapes thereof have also very great effect on such functions.

The surface of the magnetic particle of the present invention exhibits a structure of a number of ferrite crystals sintered, and the sizes of the ferrite crystals are specific in that at least 80% thereof have particle sizes of 0.5 to 50μ. Preferably at least 90% thereof have particle sizes of 1 to 20μ. The size of the ferrite crystal herein mentioned is determined by photographing randomly at least 20 surface photographs of a magnetic particle by means of a scanning type electron microscope and measuring the maximum length in the same direction within the field of vision. During photographing, however, it is required to take a photograph with the central portion of the magnetic particle as its center, while avoiding the outline portion. It is not clear why these surface structures exhibit preferable characteristics, but the effect can evidently be seen from the Examples shown below. Perhaps, possession of such a surface structure consisting of relatively regular crystals seems to contribute to uniformization of holding and release of the non-magnetic developer and further urge uniformization of interactions between the magnetic particles, whereby an averaged regulation force is generated for the brush to enable to coat uniformly the non-magnetic developer on the holding member.

As the magnetic particles to be used in the present invention, ferrites known in the art containing a metal such as Ni, Zn, Mn, Cu, Co, Fe, Ba, Mg, rare earth metals, and the like can be used. The particles may be shaped either spherical or flat and coated with a resin or a suitable treating agent. The method for preparation of the magnetic particles is not particularly limited. For example, there may be employed any of the known methods such as the method in which metal oxides capable of forming ferrite are mixed in a solution to be slurried, and then these are granulated and dried, followed further by calcining and sintering by use of a suitable sintering furnace or the method in which a starting material coprecipitated or mixed as oxides or various salts is once preliminarily sintered and then crushed, and further after granulation, completely calcined and sintered. Of course, agglomeration preventives, binders, etc. may be used, if desired.

The present inventors have made various investigations in order for the magnetic particles to be used in the present invention to satisfy various necessary functions, and consequently found that the critical surface tension of the surface of the magnetic particles has great effects on these functions.

The present inventors have also found, in the light of the fact that adhesiveness and releasability between the non-magnetic developer and the magnetic particles as well as triboelectric charging characteristic and free flowing property of the non-magnetic developer have great effect on coating and developing, that good coating condition can be accomplished by use of magnetic particles coated with a substance having a critical surface tension of $\gamma c \leqq 30$ dyne/cm thereby to control the above physical properties of the developer.

The $\gamma c$ value in excess of 30 will cause troubles such as worsening of the free flowing property of the developer as a whole and the releasability between the non-magnetic developer and the magnetic particles or insufficient image density since the coated layer becomes thinner under the conditions of low temperature and low humidity.

The critical surface tension $\gamma c$ herein mentioned refers to a value called as the surface tension value contained by measuring the contact angle $\theta$ of the objective substance with various liquids of which surface tensions are known, plotting the surface tensions of various liquids and $\cos\theta$ and extrapolating to the point of $\cos\theta = 1$.

The amount of coating applied on the magnetic particles in the present invention may be determined suitably depending on the particle sizes of the magnetic particles, the critical surface tension of the above coated substance, etc., but generally about 0.05 to 20 parts by weight per 100 parts by weight of the magnetic particles.

As the coated magnetic particles to be used in the present invention, there may be included, for example, ones prepared by applying a coating on magnetic particles, for example, surface-oxidized or unoxidized metals such as iron, nickel, cobalt, manganese, chromium, rare earth metals, etc., alloys of these metals or oxide of these metals. The magnetic particles may be shaped spherical, flat, needle, porous or in any other shape.

As the method for applying a coating on the surface of the magnetic particles, there may be employed, for example, a method comprising disolving and dispersing a coating resin or a coating resin and a charge controller in a solvent (e.g. toluene, xylene, MEK) and mixing the magnetic particles with the resulting dispersion to apply a coating on the magnetic particles according to the spray drying or fluidized bed method, followed by drying, granulation and sieving, and thereby obtaining the coated magnetic particles.

As a coating resin having a critical surface tension $\gamma c \leqq 30$ dyne/cm, there may be mentioned fluorinated vinyl resins such as polyvinyl fluoride, polyvinylidene fluoride, polytrifluoroethylene, polytetrafluoroethylene, polyhexafluoropropylene and the like, silicone resins, fluorinated epoxy resins, fluorinated polyurethane, organic acids having a fluorinated carbon group, surfactants of a fluorocarbon series, acrylic resins, styrene resins or mixtures thereof.

The present inventors have also found, in the light of the fact that adhesiveness and releasability between the non-magnetic developer and the magnetic particles as well as triboelectric charging characteristic and free flowing property of the non-magnetic developer have great effect on coating and developing, that good coating condition can be accomplished by use of magnetic particles coated with a resin having triboelectric chargeability to the same polarity as the non-magnetic developer thereby to control the above physical properties of the developer.

According to the method of the present invention, the advantages of the so called one-component jumping developing as disclosed in Japanese Laid-open Patent Publication No. 43037/1979 can of course be exhibited concerning development. Moreover, even with the use of a non-magnetic developer, it can clearly be applied on a developer holding member.

To describe this embodiment by referring to the drawing, in the developing device shown in FIG. 1, the coated magnetic particles 5 in the vessel 3 form the magnetic brush 8 by the magnetic field formed between the S-pole of the magnet 7 and the magnetic blade 6. And, by rotation of the sleeve 2, the coated magnetic particles and the non-magnetic developer are stirred and mixed, while maintaining the above magnetic brush. Under this state, on the magnetic blade side of the vessel 3, the mixture of the developer and the magnetic particles is barred of its movement by the magnetic blade 6 and ascends to be circulated in the direction of the arrowhead c.

In this way, the non-magnetic developer, through mixing with the coated magnetic particles, is triboelectrically charged by the sleeve 2 or the coated magnetic particles. The charged developer is applied by the magnetic brush 8 formed in the vicinity of the magnetic blade 6 evenly and thinly on the surface of the sleeve 2 through image force and reaches the confronting position against the photosensitive drum.

The coated magnetic particles 5 constituting the magnetic brush will not be flowed out on the sleeve 2 by setting the restraining force by the magnetic field of the magnet 7 greater than the conveying force caused by frictional force. And, if the non-magnetic developer exists within the region of the magnetic brush 8, the ratio of coated magnetic particles of the magnetic brush 8 to the developer can be maintained virtually constant by the electrostatic repelling force due to the same polarity of the coated magnetic particles and the non-magnetic developer and the rotation of the sleeve. Accordingly, even if the developer on the sleeve may be consumed by development, the developer can be supplied automatically into the region of the magnetic brush 8. Thus, it is rendered possible to effect coating by supplying constantly a predetermined quantity of the developer onto the sleeve 2.

As the method for treating the surface of the magnetic particle by coating to the same polarity as the toner, there may be employed, for example, the method in which a coating resin or a coating resin and a charge controller are disolved or dispersed in a solvent (e.g. toluene, xylene, MEK), the resulting dispersion is mixed with magnetic particles to apply coating on the magnetic particles according to the spray drying or fluidized bed method, followed by drying, granulation and sieving, and the passed fraction is used as the coated magnetic particles.

When employed for a positively chargeable toner, the coating resin may include positively chargeable resins such as polymers containing, as constituent, dimethylaminoethyl methacrylate, diethylaminoethyl methacrylate, methyl methacrylate, etc., in particular copolymers of these monomers with styrene compounds or mixtures of said polymers, and the positive charge controller may include nigrosine, copper phthalocyanine and quinophthalone and various dyes and pigments exhibiting positive chargeability.

The coating resin employed for a negatively chargeable toner may include negatively chargeable resins such as polyvinyl choride, polyethylene, polypropylene, α-chlorostyrene, polyester and others. As the positive charge controller, there may be employed chromium chelate of t-butylsalicylic acid and various dyes and pigments exhibiting negative chargeability.

The present inventors have also found, in the light of the fact that adhesiveness and releasability between the non-magnetic developer and the magnetic particles as well as triboelectric charging characteristic and free flowing property of the non-magnetic developer have great effect on coating and developing, that good coating condition can be accomplished by use of magnetic particles carrying fine silica particles having triboelectric chargeability to the same polarity as the non-magnetic developer thereby to control the above physical properties of the developer.

According to the method of the present invention, the advantages of the so called one-component jumping developing as disclosed in Japanese Laid-open Patent Publication No. 43037/1979 can of course be exhibited concerning development. Moreover, even with the use of a non-magnetic developer, it can cleanly be applied on a developer holding member.

Judgement of the polarity of the non-magnetic developer and fine silica powders was conducted by measurement according to the blow-off method with iron powder as the standard.

The fine silica particles to be used in the present invention may be those prepared according to any of the methods known in the art such as the dry process silica, wet process silica and others.

For example, as the dry process silica, there is the so called fumed silica or dry process silica, which is prepared by vapor phase oxidation of a silicon halide according to the technique known in the prior art. For example, it can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl$$

In the above preparation step, it is also possible to obtain complex fine powders of silica and other metal oxides by using other metal halide compounds such as aluminum chloride or titanium chloride together with silicon halide compounds. They are also included in the present invention.

It is preferred to use fine silica particles, of which mean primary particle size is desirably within the range from 0.001 to 2μ, particularly preferably from 0.002 to 0.2μ.

Commercially available fine silica powder formed by vapor phase oxidation of a silicon halide to be used in the present invention include those sold under the trade names as shown below.

| | |
|---|---|
| AEROSIL | 130 |
| (Nippon Aerosil Co.) | 200 |
| | 300 |
| | 380 |
| | TT 600 |
| | MOX 80 |
| | MOX170 |
| | COK 84 |
| Cab-O-Sil | M-5 |
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica | |
| (Dow Corning Co.) | |
| Fransol | |
| (Fransil Co.) | |

For preparation of wet process silica, various methods known in the art may be applicable. For example, decomposition of sodium silicate with an acid may be represented by the general scheme as follows (the reaction scheme is hereinafter omitted):

$$Na_2O.xSiO_2+HCl+H_2O \rightarrow SiO_2.nH_2O+NaCl$$

Otherwise, there may be employed the method by decomposition of sodium silicate with ammonium salts or alkali salts, by formation of an alkaline earth metal silicate from sodium silicate followed by decomposition with an acid to form silicic acid, by conversion of a sodium silicate solution into silicic acid or by utilization of natural silicic acid or silicate.

In addition, any of silicates such as aluminum silicate, sodium silicate, potassium silicate, magnesium silicate and zinc silicate may also be applicable.

Examples of commercial products are as follows:

| Trade name | Manufacturer |
|---|---|
| Nipsil | Nippon Silica Co., Ltd. |
| Tokusil, Finesil | Tokuyama Soda Co., Ltd. |
| Vitasil | Taki Fertilizer Manufacturing Co., Ltd. |
| Silton, Silnex | Mizusawa Chemical Co., Ltd. |
| Starsil | Kamishima Chemical Co., Ltd. |
| Himezil | Ehime Pharmaceutical Co., Ltd. |
| Siloid | Fuji Devidson Chemical Co., Ltd. |
| Hi-sil | Pittsburgh Plate Glass Co. |
| Durosil | Fuellstoff-Gesellschaft |
| Ultrasil | Marquart (Fuellstoff-Gesellschaft Marquart) |
| Manosil | Hardman and Holden |
| Hoesch | Chemische Fabrik Hoesch K-G |
| Sil-Stone | Stone Rubber Co. |
| Nalco | Nalco Chem. Co. |
| Quso | Philadelphia Quartz Co. |
| Santocell | Monsanto Chemical Co. |
| Imsil | Illinois Minerals Co. |
| Calcium Silikat | Chemicsche Fabric Hoesch K-G |
| Calsil | Fuellstoff-Gesellschaft Marquart |
| Fortafil | Imperial Chemical Industries, Ltd. |
| Microcal | Joseph Crosfield & Sons, Ltd. |
| Vulkasil | Farbenfabriken Bayer, A.G. |
| Tufknit | Durham Chemical, Ltd. |
| Silmos | Shiraishi Kogyo Co., Ltd. |
| Starlex | Kamishima Chemical Co., Ltd. |
| Frucosil | Taki Fertilizer Manufacturing |

-continued

| Trade name | Manufacturer |
|---|---|
| | Co., Ltd. |

These fine silica particles may be used singly as such or may be applied with some treatment in view of charging characteristic or hydrophobic modification. As the treatment conceivable, it is possible to incorporate alumina or titanium oxide in the silica. Silica particles may also be treated with a silane coupling agent.

Silane coupling agents may include those represented by the following formula:

$$R_mSiY_n$$

where R is a hydrogen atom, an alkoxy group or a halogen atom, m is an integer of 1 to 3, Y is amino, vinyl, glycidoxy, mercapto, methacryl, alkyl, alkenyl, alkynyl, ester, alkoxycarbonyl, aromatic hydrocarbon group, substituted aromatic hydrocarbon group, alkylmercapto, acyl, acylamino, nitro, imino, phenylimino, cyano, substituted azo, diazoamino, ureido, oxo or heterocyclic group, and n is an integer of 1 to 3.

It is also possible to treat silica particles with a titanate type coupling agent.

As hydrophobic modification treatment, for example, there is the method of treating silica particles with an organic silicon compound. Examples of such organic silicon compounds are hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing hydroxyl groups bonded to each one Si in the units positioned at the terminals and amino-modified silicone oils. These may be used either singly or as a mixture of two or more compounds.

Further, the above treatments may be used as a combination of two or more kinds.

It is also possible to subject silica particles to heat treatment at a temperature of 400° C. or higher for the purpose of controlling the water content adsorbed and the number of hydroxyl groups.

The fine silica particles as described above may be chosen so as to have the same polarity as the non-magnetic developer depending on its charging polarity.

As the method for carrying fine silica particles on magnetic particles, all the methods may be available. For example, fine silica particles alone may be carried or alternatively as a dispersion in a resin. In general, it is sufficient only to add externally the fine silica particles alone by means of a Henschel mixer or a V-type mixing machine.

The amount of silica particles added may be determined suitably depending on the particle sizes of the magnetic particles, particle sizes of fine silica particles, etc., but it is generally preferred to add 0.1 to 5 parts by weight of silica particles per 100 parts by weight of magnetic particles. At a lower level, improvement of free flowing property of the developer as a whole and the mold-release effect of non-magnetic developer and magnetic particles are insufficient, while an amount in excess of said range will cause attachment of too much fine silica particles on the surface of non-magnetic developer, whereby troubles such as worsening of fixing characteristic, deterioration of image due to silica contamination of the developer carrier, etc. may occur.

It is also possible to carry fine silica particles, which may be the same as or different from those on the surface of the magnetic particles, on the surface of the non-magnetic developer.

The binder resin for the non-magnetic developer to be used in the present invention may include homopolymers of styrene and derivatives thereof such as polystyrene, poly-p-chlorostyrene, polyvinyltoluene, and the like; styrene copolymers such as styrene-p-chlorostyrene copolymer, styrene-propylene copolymer, styrene-vinyltoluene copolymer, styrene vinylnaphthalene copolymer, styrene-methyl acrylate copolymer, styrene-ethyl acrylate copolymer, styrene-butylacyrlate copolymer, styrene-octyl actylate copolymer, styrene-methyl methacrylate copolymer, styrene-ethyl methacryalte copolymer, styrene-butyl methacrylate copolymer, styrene-acrylic-aminoacrylic copolymer, styrene-aminoacrylic copolymer, styrene-α-chloromethyl methacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer, and the like; polymethyl methacrylate, polybutyl methacrylate, polyvinyl chloride, polyvinyl acetate, polyethylene, polypropyelen, polyesters, polyurethanes, polyamides, epoxy resins, polyvinyl butyral, polyacrylic acid resin, rosin, modified rosins, terpene resin, phenol resins, aliphatic or alicyclic hydrocarbon resins, aromatic petroleum resin, chlorinated paraffin, paraffin wax, etc. These binder resins may be used either singly or as a mixture.

In the non-magnetic developer of the present invention, any suitable pigment or dye may be available as the colorant. For example, there may be included known dyes and pigments such as carbon black, iron black, phthalocyanine blue, ultramarine blue, quinacridone, benzidine yellow, etc.

Also, as charge controlling agents, there may be added amino compounds, quaternary ammonium compounds and organic dyes, particularly basic dyes and salts thereof, benzyldimethyl-hexadecylammonium chloride, decyl-trimethylammonium chloride, nigrosine base, nigrosine hydrochloride, safranine γ, and crystal violet, metal-containing dyes, salicylic acid metal complex, etc.

The constitution of the non-magnetic developer as described above may be used for a developer prepared according to the mixing-crushing method generally practiced, or for wall material or core material of a microcapsule developer or both.

The present invention is further illustrated by referring to the following Examples, by which the present invention is not limited at all.

EXAMPLE 1

Figure 2:
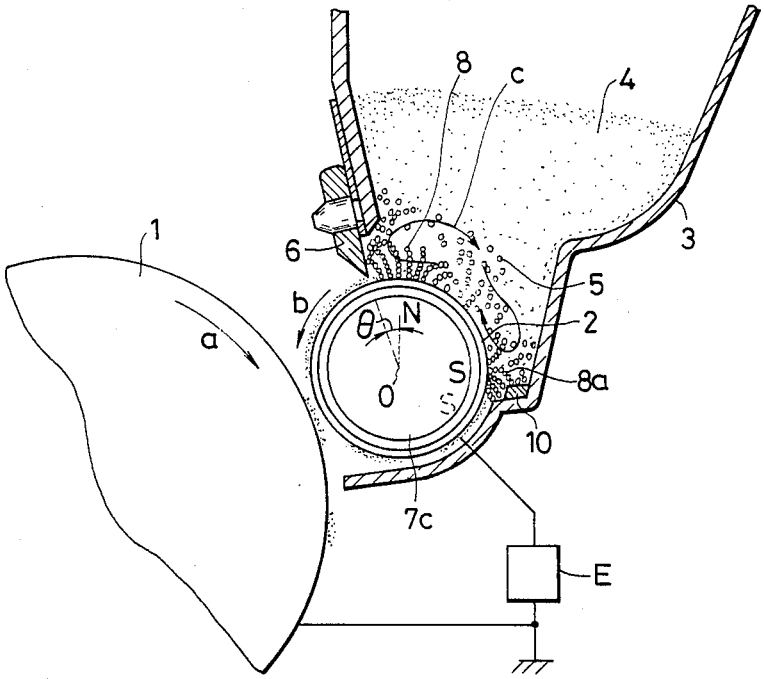
FIG. 2 is a sectional view of the developing device employed in Examples of the present invention.

Example of the present invention and Comparative Example are explained by referring to FIG. 2. In this Figure, the same symbols are attached to the same members as in FIG. 1. In the device of Example, the photosensitive drum 1 rotates in the direction of the arrowhead a at a circumferential speed of 60 mm/sec. 2 is a sleeve made of stainless steel (SUS 304) with an outer diameter of 32 mm and a thickness of 0.8 mm, which rotates at a circumferential speed of 66 mm/sec, with its surface being applied with finite type sand blast with the use of Alundum abrasive particles of #600, and the coarseness degree in the circumferential direction was made 0.8 μm (Rz=).

On the other hand, within the rotating sleeve 2, a magnet 7c of the sintered ferrite type was arranged, with the N-pole of the first magnetic pole being set at an angle of 30° (θ in the drawing) slanted from the line connecting between the center of the sleeve 2 and the blade tip with respect to the magnetic blade 6. The other S-pole of the second magnetic pole is positioned so as to confront the iron strip 10 which is a magnetic member provided at the vessel on the side for sleeve inlet.

The magnetic blade 6 is made of iron and applied on its surface with nickel plating for rust prevention. The blade 6 was set at a distance of 200 μm from the surface of the sleeve 2.

As the non-magnetic developer 4 was prepared 200 g of cyan color powder chargeable to negative (−) polarity with a mean particle size of 12 μm, comprising 3 parts of a copper phthalocyanine type pigment and 5 parts of a negative charge controller (alkylsalicylic acid metal complex) added internally and 0.5% of silica added externally to 100 parts of a polyester resin. And, after mixing well the above non-magnetic developer 4 with the magnetic particles, the mixture was placed in the vessel 3. The mixture of the non-magnetic developer and the magnetic particles within the vessel 3 could be observed under the condition where the developer was reduced, particularly with the magnetic particles being circulated by conveying with the sleeve under the magnetic field.

Figure 3:
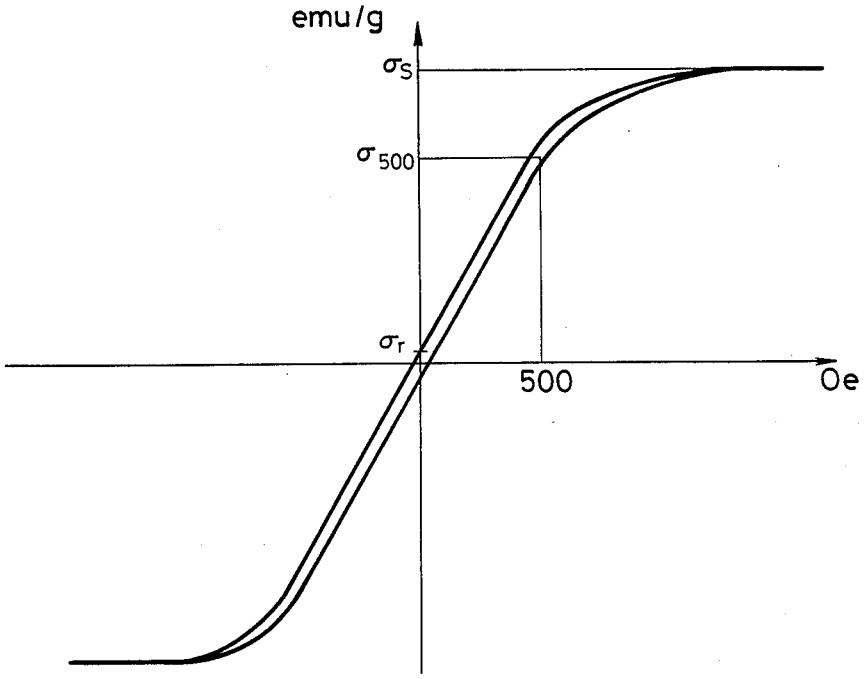
FIG. 3 is a graph of the hysteresis of the magnetic particles used in the present invention.

The magnetic particles employed here has various magnetic characteristics. The results are shown in Table 1 below. The magnetic characteristics were measured by means of a direct current magnetization characteristic measuring device (MS-T-1, produced by Toshiba Kogyo Co.) with the magnetic particles being subjected to the closest packing by tapping within the measurement cell, and $\sigma_r$, $\sigma_{500}$, $\sigma_s$ in the Table are values defined by the hysteresis curve shown in FIG. 3.

As apparently seen from Table 1, $\sigma_{500}$ and restraint are intimately related to each other, and the magnetic particles can be restrained sufficiently at a $\sigma_{500}$ of 30 emu/g or higher.

On the other hand, when $\sigma_r$ is great, the restraint will be reduced for the reason which is not clear. Also, when $\sigma_r$ is great, circulating characteristic is worsened due to magnetization of magnetic particles even in the region without magnetic field, whereby streaks or irregularities are generated. No such inconvenience is caused if $\sigma_r$ is 1 emu/g or less, as can be seen from Table 1.

As described above, by use of magnetic particles with magnetization of 30 emu/g or higher (more preferably 35 emu/g or higher) at an external magnetic field of 500 oersted, only the non-magnetic developer can be coated evenly.

TABLE 1

| | | | | | | 400Oe | | 800Oe | | 1200Oe | |
|---|---|---|---|---|---|---|---|---|---|---|---|
| | Name | Material | $\sigma_r$ emu/g | $\sigma_{500}$ emu/g | $\sigma_s$ emu/g | Re-straint | Circu-lation | Re-straint | Circu-lation | Re-straint | Circu-lation |
| Example | A | Ferrite | 0.15 | 40.5 | 70.5 | Δ | o | o | o | o | Δ |
| | B | " | 0.15 | 35.0 | 58.0 | Δ | o | o | o | o | Δ |
| | C | Iron | 0.6 | 30.0 | 170.0 | Δ | o | o | o | o | Δ |
| | D | Ferrite | 0.2 | 55.0 | 71.0 | o | o | o | Δ | o | Δ |
| Comparative example | E | Ferrite | 1.3 | 23.2 | 49.2 | x | o | x | o | Δ | Δ |
| | F | Iron | 0.6 | 26.0 | 160.0 | x | o | Δ | o | o | x |
| | G | " | 5.0 | 50.0 | 154.0 | x | Δ | Δ | x | o | x |
| | H | Ferrite | 0.2 | 23.0 | 58.0 | x | o | x | o | Δ | o |

EXAMPLE 2

The same device as in Example 1 except that the outer diameter of the sleeve was 20 mm. The magnetic flux density on the sleeve surface of the second magnetic pole was 650 Gauss at its peak value in the presence of the iron strip 10, and 400 Gauss under the state where the iron strip 10 was removed. As to the positional relation between the second magnetic pole and the iron strip 10, the width of the iron strip in the direction of sleeve rotation was 0.5 mm, and the distance between the sleeve 2 and the iron strip was set at 1.0 mm.

The blade 6 was set at a distance of 100 μm from the surface of the sleeve 2.

As the magnetic particles 5 were employed 70 g of spherical iron powder with particle sizes of 80 to 100μ (number average particle size of 90μ, particles with sizes of 80 to 100μ comprising 100% in number of all the particles). On the other hand, as the non-magnetic developer 4, there was employed a mixture prepared by adding externally 0.5% calloidal silica to a toner with an average particle size of 12μ comprising 100 parts of a styrene-acrylic resin, 10 parts of an azo type pigment and 5 parts of an aminoacrylic resin.

And, after the above non-magnetic developer and the magnetic particles were mixed well, the mixture was placed into the vessel 3. The mixture of the non-magnetic developer and the magnetic particles within the vessel could be observed under the condition where the developer was reduced, particularly with the magnetic particles being circulated by conveying with the sleeve under the magnetic field.

In the developing device having the above constitution, a thin film layer of only the non-magnetic developer with a thickness of about 50 μm could be formed on the surface of the sleeve 2 with rotation of the above sleeve. When the charging potential of this developer layer was measured according to the blow-off method, it could be confirmed to be charged evenly at a potential of +8 μC/g.

On the surface of the photosensitive drum 1 confronting the sleeve 2 was formed as the electrostatic latent image a charge pattern at −600 V at the dark portion and −150 V at the light portion, and the distance from the sleeve surface was set at 300 μm. And, when a voltage of a frequency of 800 Hz, a peak to peak value of 1.4 kV and a center value of −300 V was applied on the above sleeve from the power source E, there could be obtained a clear red developed image of high quality without development irregularity, ghost image and further fog.

Concerning the mixture in the vessel 3, only the non-magnetic developer was consumed substantially without consumption of the magnetic particles. The developing function was invariably stable until the above developer was almost consumed. After the above developer had been consumed, the developing device was taken out from the main body for observation of the lower part of the sleeve 2, where no leak of magnetic particle, as a matter of course, and also of developer was found to occur.

When an image was obtained similarly under low temperature and low humidity conditions of 15° C. and 10% RH, a good image of high resolution without fog or scattering could be obtained.

EXAMPLE 3

Example 2 was repeated except that 100 g of spherical ferrite powder with particle sizes of 120 to 140μ (number average particle size of 130μ, and particles with sizes of 120 to 140μ comprise 100% in number of all the particles) was employed as the magnetic particles 5 and the blade 6 was set with a distance of 200μ from the surface of the sleeve 2. As a result, similarly good results could be obtained.

EXAMPLE 4

Example 2 was repeated except that 100 g of flat iron powder with particle sizes from 30 to 60μ (number average particle size of 50μ), of which particles with sizes of 40 to 60μ comprise 70% in number of all the particles, was employed as the magnetic particles 5 and the blade 6 was set with a distance of 70μ from the surface of the sleeve 2. As a result, similarly good results could be obtained.

EXAMPLE 5

Example 2 was repeated except that 100 g of spherical ferrite powder with particle sizes from 50 to 100μ (number average particle size of 80μ), of which particles with sizes of 64 to 95μ comprises 83% in number of the particles, was employed as the magnetic particles 5 and the blade 6 was set with a distance of 250μ from the surface of the sleeve 2. As a result, similarly good results could be obtained.

Comparative Example 1

Example 2 was repeated except that 100 g of spherical ferrite powder with particle sizes from 200 to 250μ (number average particle size of 230μ), of which particles with sizes of 180 to 270μ comprises 60% in number of the particles, was employed as the magnetic particles 5. As a result, fogging in shape of fine streaks was generated under the environment of 15° C. and 10% RH.

Comparative Example 2

Example 3 was repeated except that 100 g of spherical ferrite powder with particle sizes from 25 to 50μ (number average particle size of 30μ), of which particles with sizes of 25 to 36μ comprise 50% in number of the particles, was employed as the magnetic particles 5. As a result, magnetic particles were flown out and attached on the image under the environment of 15° C. and 10% RH.

EXAMPLE 6

The same device as in Example 1 was employed, but the blade 6 was set at a distance of 200 μm from the surface of the sleeve 2.

As the magnetic particles 5, 100 g of spherical ferrite particles with particles sizes of 70 to 100μ with 60 emu/g at the maximum were employed. When the ferrite particles were observed with a scanning type electron microscope, its surface was found to be constituted of at least 90% of relatively uniform crystals of 1 to 20μ.

On the other hand, as the non-magnetic developer 4 was prepared 200 g of cyan color powder chargeable to negative (−) polarity with a mean particle size of 12 μm, comprising 10 parts of a copper phthalocyanine type pigment and 5 parts of a negative charge controller (alkylsalicylic acid metal complex) added internally and 0.5% of silica added externally to 100 parts of a polyester resin. And, after mixing well the above non-magnetic developer 4 with the magnetic particles, the mixture was placed in the vessel 3. The mixture of the non-magnetic developer and the magnetic particles within the above vessel 3 could be observed under the condition where the developer was reduced, particularly with the magnetic particles being circulated by conveying with the sleeve under the magnetic field.

In the developing device having the above constitution, a thin film layer of only the non-magnetic developer with a thickness of about 80 μm could be formed on the surface of the sleeve 2 with rotation of the above sleeve. When the charging potential of this developer layer was measured according to the blow-off method, it could be confirmed to be charged evenly at a potential of −7 μC/g.

On the surface of the photosensitive drum 1 confronting the sleeve 2 was formed as the electrostatic latent image a charge pattern at +600 V at the dark portion and +150 V at the light portion, and the distance from the sleeve surface was set at 300 μm. And, when a voltage of a frequency of 800 Hz, a peak to peak value of 1.4 kV and a center value of +300 V was applied on the above sleeve from the power source E, there could be obtained a clear blue developed image of high quality without development irregularity, ghost image and further fog.

Concerning the mixture in the vessel 3, only the non-magnetic developer was consumed substantially without consumption of the magnetic particles. The developing function was invariably stable until the above developer was almost consumed. After the above developer had been consumed, the developing device was taken out from the main body for observation of the lower part of the sleeve 2, where no leak of magnetic particle, as a matter of course, and also of developer was found to occur.

EXAMPLE 7

The distance between the blade 6 and the sleeve 2 was set at 100μ, and as the magnetic particles 5 were employed ferrite particles with particle sizes of 50 to 70μ and 61 emu/g at the maximum, of which surfaces comprise 80 to 90% of 0.5 to 10μ crystals. Further, as the non-magnetic developer 4, a mixture prepared by adding 0.5% of colloidal silica to a toner comprising 100 parts of a styrene-acrylic resin, 10 parts of an azo type pigment and 5 parts of an aminoacrylic resin. As the photosensitive drum 1, an OPC photosensitive member was employed. With the constitution as mentioned above, the experiment was conducted similarly as in Example 6. As a result, the circulating characteristic of magnetic particles was adequate, and a thin layer only of the non-magnetic developer could be formed. Further, when the electrostatic image on the photosensitive drum 1 was developed by use of the thin layer of the non-magnetic developer, very good red developed image could be obtained. The above developing function was invariably stable until the above non-magnetic developer 4 was almost consumed without leak to the lower part of the sleeve 2.

EXAMPLE 8

When Example 7 was repeated except that the distance between the blade 6 and the sleeve 2 was set at 250μ and spherical ferrite particles of which surfaces comprise 80 to 90% of 1 to 50μ crystals were employed as the magnetic particles 5, good results were obtained.

Comparative Example 3

When Example 8 was repeated except that spherical ferrite particles of which surfaces comprise 30% of crystal with sizes of 50 to 80μ were employed as the magnetic particles 5, evenness of the coated layer on the surface of the sleeve 2 was inferior. Particularly, when the amount of the non-magnetic developer 4 was greater as compared with the magnetic particles 5, fog was generated on the image, and leak of the non-magnetic developer and magnetic particles at the lower portion of the sleeve 2 was recognized.

EXAMPLE 9

The same device as in Example 1 was employed. The magnetic flux density on the sleeve surface of the second magnetic pole was 650 Gauss at its peak value in the presence of the iron strip 10, and 400 Gauss under the state where the iron strip 10 was removed. As to the positional relation between the second magnetic pole and the iron strip 10, the width of the iron strip in the direction of sleeve rotation was 0.5 mm, and the distance between the sleeve 2 and the iron strip was set at 1.0 mm. The blade 6 was set at a distance of 200 μm from the surface of the sleeve 2.

As the magnetic particles 5, 100 parts by weight of spherical ferrite with particle sizes of 70 to 100μ and 60 emu/g at the maximum are dispersed in 15 parts by weight of an emulsion of polytetrafluoroethylene (critical surface tension of 18.5 g dyne/cm), and spray dried by means of a spray drying device to obtain coated magnetic particles, of which 100 g was taken out.

On the other hand, as the non-magnetic developer 4, there was prepared 200 g of a blue powder with an average particle size of 10 μm chargeable to the positive (+) polarity by adding internally 8 parts of a copper phthalocyanine type pigment and 2 parts of a positive charge controller (nigrosine type) to 100 parts of a styrene-acrylic resin. And, after the above non-magnetic developer and the magnetic particles were mixed well, the mixture was placed into the vessel 3. The mixture of the non-magnetic developer and the magnetic particles within the vessel could be observed under the condition where the developer was reduced, particularly with the magnetic particles being circulated by conveying with the sleeve under the magnetic field.

In the developing device having the above constitution, a thin film layer of only the non-magnetic developer with a thickness of about 70 μm could be formed on the surface of the sleeve 2 with rotation of the above sleeve. When the charging potential of this developer layer was measured according to the blow-off method, it could be confirmed to be charged evenly at a potential of +8 μC/g.

On the surface of the photosensitive drum 1 confronting the sleeve 2 was formed as the electrostatic latent image a charge pattern at −550 V at the dark portion and −100 V at the light portion, and the distance from the sleeve surface was set at 300 μm. And, when a voltage of a frequency of 800 Hz, a peak to peak value of 1.4 kV and a center value of −200 V was applied on the above sleeve from the power source E, there could be obtained a clear developed image of high quality without development irregularity, ghost image and further fog.

Concerning the mixture in the vessel 3, only the non-magnetic developer was consumed substantially without consumption of the coated magnetic particles. The developing function was invariably stable until the above developer was almost consumed. After the above developer had been consumed, the developing device was taken out from the main body for observation of the lower part of the sleeve 2, where no leak of magnetic particle, as a matter of course, and also of developer was found to occur.

In the present invention, the number of magnetic poles provided within the sleeve is not restricted to two of the first and second magnetic poles. And, the object of the magnetic brush formed by the second magnetic pole is not limited to a magnetic member but it may be the wall of the vessel. In this case, the presence of a magnetic member is not required and the pole takes the shape of S-pole as shown by the broken line in FIG. 2. Also, when a magnetic member is employed for the second magnetic pole, if the vessel is a magnetic material, the blade 6 and the iron strip 10 shown in FIG. 2 can be constituted of the wall of the vessel, and the iron strip can be replaced with a portion of a part of the vessel shaped in a convex in the axis direction of the sleeve.

In the above Examples, an S-pole was employed as the second magnetic pole, but of course an N-pole may be used. As to the regulating means, a blade plate made of a magnetic material was shown by way of example, but wall or plate members made of non-magnetic materials such as synthetic resins, aluminum, brass, stainless steel, etc. may also be available. However, when a non-magnetic material is employed, no magnetic field is generated between the material and the first magnetic pole as in the case of using a magnetic material, and therefore the mode of the brush of the magnetic particles within the vessel becomes different, whereby the magnetic particles will readily be flowed out from the downstream side of the vessel. However, this point can be solved by setting the gap between the sleeve and the regulating means of a non-magnetic material at about half the magnetic particle size. Further, concerning the regulating member, except for mounting on a body separated from the vessel, a part of the vessel can be used as the regulating means. And, further, the bias during development is not limited to an alternating current, but a direct voltage can also effectively be used.

EXAMPLE 10

As the magnetic particles 5, the magnetic material employed in Example 9 was dispersed in 20 parts by weight of an emulsion of polyvinylidenefluoroethylene (critical surface tension of 25.0 g dyne/cm), and spray dried by means of a spray drying device to obtain coated magnetic particles, of which 100 g was taken out.

Following otherwise the same procedure as in Example 9, a thin layer only of the non-magnetic developer with a 90 μm thickness charged to +7.5 μC/g could be formed on the sleeve 2 to give a good image.

EXAMPLE 11

The same device as in Example 1 was employed. The magnetic flux density on the sleeve surface of the second magnetic pole was 650 Gauss at its peak value in the presence of the iron strip 10, and 400 Gauss under the state where the iron strip 10 was removed. As to the positional relation between the second magnetic pole and the iron strip 10, the width of the iron strip in the direction of sleeve rotation was 0.5 mm, and the distance between the sleeve 2 and the iron strip was set at 1.0 mm. The blade 6 was set at a distance of 200 μm from the surface of the sleeve 2.

As the non-magnetic developer 4, 200 g of red powder with an average particle size of 10.6 μm chargeable to the negative polarity (−) was prepared by adding internally 10 parts of a perylene type red pigment and 5 parts of a negative charge controller (alkylsalicylic acid metal complex) and adding externally 0.5% of silica to 100 parts of a styrene-maleic acid copolymer.

On the other hand, as the coated magnetic particles, 100 g of spherical ferrite with particle sizes of 70 to 100μ and 60 emu/g at the maximum was added to a solution of 20 g of a polyester resin and 2 g of an alkylsalicylic acid metal complex dissolved in 200 ml of toluene, stirred for 60 minutes, followed by drying and sieving, to prepare coated particles.

After the above non-magnetic developer and the magnetic particles were mixed well, the mixture was placed into the vessel 3. The mixture of the non-magnetic developer and the magnetic particles within the vessel could be observed under the condition where the developer was reduced, particularly with the magnetic particles being circulated by conveying with the sleeve under the magnetic field.

In the developing device having the above constitution, a thin film layer of only the non-magnetic developer with a thickness of about 110 μm could be formed on the surface of the sleeve 2 with rotation of the above sleeve. When the charging potential of this developer layer was measured according to the blow-off method, it could be confirmed to be charged evenly at a potential of −9.8 μC/g.

On the surface of the photosensitive drum 1 confronting the sleeve 2 was formed as the electrostatic latent image a charge pattern at +600 V at the dark portion and +150 V at the light portion, and the distance from the sleeve surface was set at 300 μm. And, when a voltage of a frequency of 800 Hz, a peak to peak value of 1.4 kV and a center value of +300 V was applied on the above sleeve from the power source E, there could be obtained a clear developed image of high quality without development irregularity, ghost image and further fog.

Concerning the mixture in the vessel 3, only the non-magnetic developer was consumed substantially without consumption of the coated magnetic particles. The developing function was invariably stable until the above developer was almost consumed. After the above developer had been consumed, the developing device was taken out from the main body for observation of the lower part of the sleeve 2, where no leak of magnetic particle, as a matter of course, and also of developer was found to occur.

EXAMPLE 12

As the non-magnetic developer, 200 g of red powder with an average particle size of 11.0 μm chargeable to the positive polarity (+) was prepared by adding internally and mixing 15 parts by weight of a copper phthalocyanine pigment with 100 parts of a styrene-acrylic copolymer, followed by external addition of 0.5 wt. % of silica.

As the coated magnetic particle, 100 g of the ferrite employed in Example 11 was added into a solution of 20 g of diethylaminoethyl methacrylate in 200 ml of DMF to prepare coated magnetic particles.

After both of these were mixed well, the mixture was placed into the vessel 3 in the same manner as in Example 11.

In the developing device having the above constitution, blank rotation was performed continuously for 10 hours. As the result, a thin film layer only of the non-magnetic developer with a thickness of about 140 μm could be formed on the surface of the sleeve 2. When the charging potential of this developer layer was measured according to the blow-off method, it could be confirmed to be charged evenly at a potential of +11.6 μC/g.

On the surface of the photosensitive drum 1 confronting the sleeve 2 was formed as the electrostatic latent image a charge pattern at −600 V at the dark portion and −150 V at the light portion, and the distance from the sleeve surface was set at 300 μm. And, when a voltage of a frequency of 800 Hz, a peak to peak value of 1.4 kV and a center value of −300 V was applied on the above sleeve from the power source E, there could be obtained a clear red developed image of high quality without development irregularity, ghost image and further fog.

EXAMPLE 13

The same device as in Example 1 was employed. The magnetic flux density on the sleeve surface of the second magnetic pole was 650 Gauss at its peak value in the presence of the iron strip 10, and 400 Gauss under the state where the iron strip 10 was removed. As to the positional relation between the second magnetic pole and the iron strip 10, the width of the iron strip in the direction of sleeve rotation was 0.5 mm, and the distance between the sleeve 2 and the iron strip was set at 1.0 mm. The blade 6 was set at a distance of 200 μm from the surface of the sleeve 2.

As the above magnetic particles 5, to 100 parts by weight of spherical ferrite with particle sizes of 70 to 100μ and 60 emu/g at the maximum (produced by TDK Co.) was externally added 1 part by weight of fine silica particles chargeable to negative (produced by Nippon Aerosil Co., R-972) by a Henscel mixer, and 100 g of the preparation was taken out.

On the other hand, as the non-magnetic developer 4, there was prepared 200 g of a cyan color powder with an average particle size of 12 μm chargeable to the negative (−) polarity by adding internally 3 parts of a copper phthalocyanine type pigment and 5 parts of a negative charge controller (alkylsalicylic acid metal complex) to 100 parts of a polyester resin. And, after the above non-magnetic developer and the magnetic particles were mixed well, the mixture was placed into the vessel 3. The mixture of the non-magnetic developer and the magnetic particles within the vessel could be observed under the condition where the developer was reduced, particularly with the magnetic particles being circulated by conveying with the sleeve under the magnetic field.

In the developing device having the above constitution, a thin film layer of only the non-magnetic developer with a thickness of about 100 μm could be formed on the surface of the sleeve 2 with rotation of the above sleeve. When the charging potential of this developer layer was measured according to the blow-off method, it could be confirmed to be charged evenly at a potential of −6 μC/g.

On the surface of the photosensitive drum 1 confronting the sleeve 2 was formed as the electrostatic latent image a charge pattern at +600 V at the dark portion and +150 V at the light portion, and the distance from the sleeve surface was set at 300 μm. And, when a voltage of a frequency of 800 Hz, a peak to peak value of 1.4 kV and a center value of +300 V was applied on the above sleeve from the power source E, there could be obtained a clear developed image of high quality without development irregularity, ghost image and further fog.

Concerning the mixture in the vessel 3, only the non-magnetic developer was consumed substantially without consumption of the magnetic particles. The developing function was invariably stable until the above developer was almost consumed. After the above developer had been consumed, the developing device was taken out from the main body for observation of the lower part of the sleeve 2, where no leak of magnetic particle, as a matter of course, and also of developer was found to occur.

EXAMPLE 14

Fine silica powder Aerosil 200 (produced by Nippon Aerosil Co.) were charged into a sealed type Henscel mixer heated to 70° C. and, while adding dropwise γ-aminopropyltriethoxysilane diluted with alcohol so that the treatment amount of the silane coupling agent might be 10 wt. % based on the silica, the mixture was stirred at high speed. After the fine particles obtained were dried at 120° C., they were charged again into the Henscel mixer and dimethyldichlorosilane was sprayed thereon under stirring in an amount of 10 wt. % based on said silica. The mixture was stirred at room temperature at high speed for 2 hours, further at 80° C. for 24 hours and the mixer was opened to atmospheric pressure. The mixture was further dried at 60° C. with stirring at low speed under an atmospheric pressure for 5 hours to obtain positively chargeable fine silica powder. One part by weight of this silica powder was added externally to 100 parts by weight of the magnetic particles employed in Example 1 by means of a Henscel mixer, and 100 g was taken out.

On the other hand, as the non-magnetic developer 4, 150 g of positively chargeable powder with an average particle size of 10 μm was prepared by adding internally 5 parts of rhodamine type pigment and 2 parts of a positive charge controlled (nigrosine type) to 100 parts of a styrene-acrylic resin.

As the electrostatic latent image on the photosensitive drum surface, a charge pattern was formed at −600 V at the dark portion and −200 V at the light portion, and the same procedure of Example 1 was repeated except for applying a voltage of a frequency of 1000 Hz, a peak to peak value of 1.3 kV and a center value of −300 V to the sleeve. As the result, the sleeve was coated evenly with the non-magnetic developer charged to +8 μC/g and a good image was obtained.

What we claim is:

1. Method for coating a developer on a developer holding member comprising the steps of:

supplying a non-magnetic developer and magnetic particles having a magnetization of 30 emu/g or higher in an external magnetic field of 500 oersted from a storage vessel onto a surface of a developer holding member; and moving the holding member bearing non-magnetic developer and magnetic particles between a regulating member positioned at the downstream side outlet of the vessel, with respect to the movement direction of the holding member, and a magnetic pole positioned on the opposite side of the holding member to form a magnetic brush with the magnetic particles on the upstream side of the regulating member and inside the vessel to retain substantially the magnetic particles within the vessel and form a thin layer of the non-magnetic developer on the developer holding member downstream of the regulating member.

2. A method for coating a developer according to claim 1, wherein the residual magnetic flux density of the magnetic particles is 1 emu/g or less.

3. A method for coating a developer according to claim 1, wherein the number average particle size $\gamma$ as measured for the maximum length of said magnetic particles and the gap d between said regulating member and the surface of said developer holding member satisfy the following equation:

$$n\bar{\gamma}=d$$

where $1.00 \leqq n \leqq 5.00$, and d is a value not smaller than the average particle size of the non-magnetic developer.

4. A method for coating a developer according to claim 3, wherein the range of the particle size of the magnetic particles is such that 70% or more in number of the total particles are included within ±20% of said average particle size $\overline{\gamma}$.

5. A method for coating a developer according to claim 1, wherein said magnetic particles have surfaces constituted of ferrite crystals of which at least 80% have particle sizes of 0.5 to 50μ.

6. A method for coating a developer according to claim 1, wherein said magnetic particles are coated with a substance having a critical surface tension of $\gamma c \leqq 30$ dyne/cm.

7. A method for coating a developer according to claim 6, wherein the magnetic particles are coated with a coating substance at a proportion of 0.05 to 20 parts by weight of the coating substance per 100 parts by weight of the magnetic particles.

8. A method for coating a developer according to claim 1, wherein said magnetic particles are covered with coatings, and the triboelectric charging characteristic of the toner relative to the developer holding member and the triboelectric charging characteristic of the magnetic particles relative to the developer holding member are of the same polarity.

9. A method for coating a developer according to claim 1, wherein the magnetic particles are provided with fine silica particles having a triboelectric charging characteristic of the same polarity as the non-magnetic developer carried on the surfaces.

10. A method for coating a developer according to claim 9, wherein the fine silica particles are treated with a silane coupling agent.

11. A method for coating a developer according to claim 9, wherein the fine silica particles are treated with an organic silicon compound.

12. A method for coating a developer according to claim 9, wherein the fine silica particles are subjected to heat treatment at a temperature of 400° C. or higher.

13. A method for coating a developer according to claim 9, wherein 0.1 to 5% by weight of the fine silica particles are used based on the magnetic particles.

* * * * *

UNITED STATES PATENT AND TRADEMARK OFFICE

CERTIFICATE OF CORRECTION

PATENT NO. : 4,571,372

DATED : February 18, 1986

INVENTOR(S) : Urawa et al.

It is certified that error appears in the above-identified patent and that said Letters Patent is hereby corrected as shown below:

Column 2, line 2, change "abovementioned" to --above-mentioned--.

Column 5, line 45, change "$1.00<n<5.00$," to --$1.00\leq n\leq 5.00$,--.

Column 6, line 10, change "$(1.00<n<5.00)$," to --$(1.00\leq n\leq 5.00)$,--.

Column 7, lines 31-2, change "co-tained" to --obtained--.

Column 7, line 54, change "disolving" to --dissolving--.

Column 8, line 64, change "disolved" to --dissolved--.

Column 10, line 57, change "Stone" to --Stoner--.

Column 10, line 62, change "Chemicsche Fabric" to --Chemische Fabrik--.

Column 12, line 35, change "polypropyelen," to --polypropylene,--.

Column 14, line 44, change "calloidal" to --colloidal--.

Column 15, line 47, change "comprises" to --comprise--.

Column 15, line 57, change "comprises" to --comprise--.

Column 22, line 1, change "controlled" to --controller--.

UNITED STATES PATENT AND TRADEMARK OFFICE

CERTIFICATE OF CORRECTION

PATENT NO. : 4,571,372

DATED : February 18, 1986

INVENTOR(S) : Urawa et al.

It is certified that error appears in the above-identified patent and that said Letters Patent is hereby corrected as shown below:

Column 22, line 28, change "substantially the" to --substantially all the--.

Column 22, line 36, change "the number average" to --the average--.

Signed and Sealed this

Twenty-eighth Day of October, 1986

[SEAL]

*Attest:*

DONALD J. QUIGG

*Attesting Officer*

*Commissioner of Patents and Trademarks*